United States Patent [19]

Goudey et al.

[11] 4,228,410

[45] Oct. 14, 1980

[54] MICROWAVE CIRCULAR POLARIZER

[75] Inventors: Kenneth R. Goudey, Sunnyvale; Attilio F. Sciambi, Jr., Los Altos, both of Calif.

[73] Assignee: Ford Aerospace & Communications Corp., Dearborn, Mich.

[21] Appl. No.: 4,628

[22] Filed: Jan. 19, 1979

[51] Int. Cl.[2] ..... H01P 1/16; H01P 5/16

[52] U.S. Cl. ..... 333/122; 333/135; 333/21 A; 333/157; 343/858

[58] Field of Search ..... 333/21 A, 117, 122, 333/125, 126, 135, 137, 156–158, 160, 161; 343/100 PE, 756, 786, 858

[56] References Cited

U.S. PATENT DOCUMENTS

| | | | |
|---|---|---|---|
| 2,832,054 | 4/1958 | Fox | 333/117 X |
| 3,790,941 | 2/1974 | Chivers et al. | 343/100 PE |
| 3,978,434 | 8/1976 | Morz et al. | 333/21 A X |
| 4,047,128 | 9/1977 | Morz | 333/21 A X |
| 4,162,463 | 7/1979 | Di Tullio et al. | 333/21 A X |

*Primary Examiner*—Paul L. Gensler

*Attorney, Agent, or Firm*—Peter Abolins; Clifford L. Sadler

[57] ABSTRACT

This specification discloses a microwave circular polarizer for converting a linearly polarized microwave signal to a circularly polarized microwave signal and vice versa. A transducer, such as an Orthomode junction is used to obtain a power split or a power recombination of two orthogonal linear polarizations. To obtain the phase delay required to generate a circularly polarized signal from two linearly polarized signals, the polarizer includes a phase compensator with a pair of waveguides which have appropriate width and length so that signals passing therethrough develop a phase difference therebetween and a composite circularly polarized signal results. The amount of phase shift occurring in each of the waveguides varies with the frequency of the signal in such a way as to produce a high purity circular polarization over a broad frequency band. A phase shift of 90° can be obtained at two frequencies and these frequencies can be selected so that they are within a frequency band having a desirably low axial ratio.

10 Claims, 5 Drawing Figures

MICROWAVE CIRCULAR POLARIZER

BACKGROUND OF THE INVENTION (1) Field of the Invention

This invention relates to polarizers for converting a linearly polarized microwave signal to an elliptically polarized microwave signal and vice versa.

(2) Prior Art

The prior art teaches a variety of ways to convert a linearly polarized microwave signal to a circularly polarized microwave signal and vice versa. For example, the transformation between a linear and a circular polarization can be accomplished by a septum polarizer. A septum polarizer usually is a threeport waveguide device where the number of ports refers to the physical ports of the devices described hereinafter. It may be formed from circular waveguides, but more typically is formed by two rectangular waveguides that have a common wide or H-plane walls. The two rectangular waveguides are transformed by a sloping septum into a single square waveguide. Various prior art septum polarizer designs are illustrated and described in U.S. Pat. No. 3,958,193 issued May 18, 1976 to James V. Rootsey, assigned to Aeronutronic Ford Corporation now Ford Aerospace and Communications Corporation, the assignee of the present invention.

In a septum polarizer, a linearly polarized transverse electric field microwave signal is converted, through the action of the septum, into a circularly polarized (CP) microwave signal and vice versa. The linearly polarized signal is introduced into one of the two rectangular waveguide ports and produces in the square waveguide port a microwave signal having either right-hand circular polarization (RHCP) or left-hand circular polarization (LHCP). Whether (RHCP) or (LHCP) is produced depends upon which of the two rectangular waveguide ports is excited. It is possible and in some applications very desirable to introduce simultaneously in both of the rectangular waveguide ports linearly polarized signals to produce in the square waveguide port both RHCP and LHCP signals or vice versa. The two linearly or circularly polarized signals may constitute separate information channels. If the RHCP and LHCP signals co-existing in the square waveguide port have perfect circular polarization characteristics, they are completely isolated from one another and there is no interference between them.

A perfect CP signal has a rotating electric field that can be regarded as the vector resultant of two orthogonal components $E_x$ and $E_y$ having sinusoidally varying magnitudes that are exactly equal in amplitude but 90° out of phase with one another. The closer simultaneously existing RHCP and LHCP signals come to the perfect CP signal, the greater is the isolation between them. The axial ratio AR is the ratio of $E_x$ to $E_y$ and is an indication of the degree to which a CP signal has departed from the ideal. In dB, the axial ratio AR is equal to 20 log $E_x/E_y$. Perfect CP signals have an AR of 0 dB.

The problem associated with prior art polarizers is their inability to provide low axial ratios over a moderately wide frequency band and also to provide a low voltage standing wave ratio (VSWR) over such band. In order to convert a perfectly linearly polarized signal to a perfectly CP signal or vice versa, the polarizer must produce exactly 90° phase shift between one of the orthogonal components of the CP signal electric field and the linear electric field in the rectangular waveguide port. Many prior art designs provide a phase-shift-angle vs. frequency function that has no inflection point in its slope. In other words, the phase shift angle, as a function of frequency over the useful frequency range of the polarizer, has a rate of change or slope that remains either positive or negative (whether the slope is positive or negative depends upon the conditions selected as a reference.). The phase angle deviations from 90° produce axial ratio increases of about 0.15 dB/degree difference from 90°. Prior art designs which do have an inflection in the phase shift angle vs. frequency function are not readily compatible with all antenna types and have limited flexibility in selecting the slope of the function around the point of inflection. In particular, there are applications for which the prior art does not provide a sufficiently broad frequency band with a sufficiently low axial ratio. These are some of the problems this invention overcomes.

SUMMARY OF THE INVENTION

A polarizer for converting a linearly polarized microwave signal to an elliptically polarized signal, (e.g., a circularly polarized signal) and vice versa includes a first transducer means and a first polarization adjusting means. The first transducer means has first, second and third ports and permits passage to the first port of first and second signals of the same frequency, which are orthogonally polarized with respect to each other. The second port permits passage of the first signal and blocks passage of the second signal. The third port permits passage of the second signal and blocks passage of the first signal. The first polarization adjusting means has four ports, denoted a fourth port, a fifth port, a sixth port and a seventh port. The fourth port and fifth ports are coupled to the second and third ports and pass the first and second signals respectively. The sixth and seventh ports are adapted to pass two signals of the same frequency as the first and second signals which are orthogonally polarized with respect to each other. One signal passes through the sixth port and one signal passes through the seventh port.

The first polarization adjusting means is operable to adjust the polarization of signals passing therethrough with a relatively high degree of isolation between polarizations over a relatively broad frequency band. The polarization adjusting means has a first compensation guide coupled between the fourth and sixth ports and a second compensation guide coupled between the fifth and seventh ports. The first and second compensation guides have a width and a length suitable for adjusting the polarization of the signals passing therethrough by changing the relative phase with respect to time in the two signals. The first and second compensation guides each have a different length and width with respect to microwave signal propagation so that the phase vs. frequency characteristic of the signal has a point of inflection and there can be two frequencies at which the phase shift is a desired number of degrees. For example, if circular polarization is desired then the phase shift must be exactly 90°, if linear polarization is desired then the phase shift must be exactly 180°, with intermediate values of phase shift producing elliptical polarization.

In accordance with theory, a linearly polarized signal can be circularly polarized by first splitting the linearly polarized signal into two equal orthogonal components and then providing a time phase difference between the two components so that the resultant produced is a circularly polarized signal. Conversely, a circularly polarized signal can be transformed into a linearly polarized signal by splitting the circularly polarized signal into two orthogonal components and delaying one of the components with respect to the other of the components so that they are then in phase when they are recombined.

DETAILED DESCRIPTION OF THE INVENTION

Figure 1:
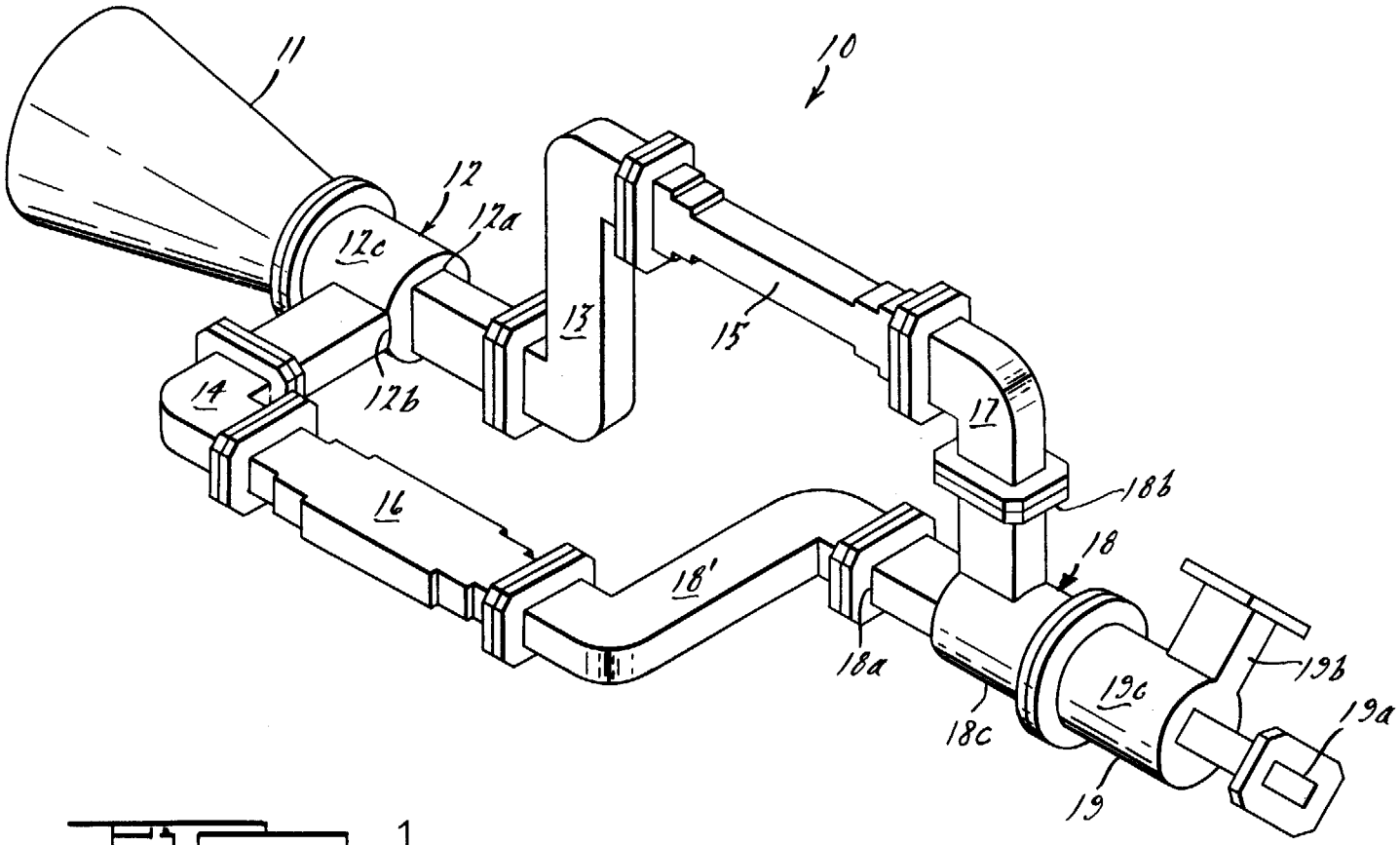
FIG. 1 is a perspective view of a circular polarizer in accordance with an embodiment of this invention.

With reference to the drawings, wherein like numerals refer to like parts in the several views, there are shown the apparatus and characteristics of a circular polarizer. Referring to FIG. 1, a circular polarizer 10 includes a horn 11 having a generally symmetrical shape funneling to a symmetrical axial input of a dual mode transducer such as an Orthomode junction 12 which has a rectangular axial port **12*a* and a rectangular radial port 12*b* in a symmetrical section 12*c*. A length of rectangular waveguide 13 is attached to port 12*a* and a length of rectangular waveguide 14 is attached to port 12*b*. Waveguides 13 and 14 both have bends to facilitate connection of additional components of circular polarizer 10**.

Compensation guides 15 and 16 are coupled to waveguides 13 and 14, respectively. Lengths of rectangular waveguide 17 and 18 are coupled to compensation guides 15 and 16, respectively, and connect compensation guides 15 and 16 to an Orthomode junction 18. Waveguides 17 and 18' also have 90° bends to facilitate connection. Orthomode junction 18 has a circular waveguide section **18*c* which has a rectangular radial port 18*b* in the wall thereof which is connected to waveguide length 17. A rectangular port 18*a* in the axial end of Orthomode junction 18 is connected to waveguide 18'. Connected to circular waveguide section 18*c* is a circular section 19*c* of an Orthomode junction 19 which also has a rectangular radial port 19*b* in the wall of circular section 12*c* and a rectangular axial port 19*a* in the axial end of Orthomode junction 19**.

The widths of the long H side of compensation guides 15 and 16 are not constant so that the velocity of propagation of an electric magnetic wave in compensation guides 15 and 16 is varied. In effect, the parallel waveguide paths between Orthomode junctions 18 and 12 have a length and width such that over a relatively broad range of frequencies the signals passing through the two paths are displaced 90° with respect to one another in time and circular polarization results. For example, a linearly polarized wave applied to radial port **19*b* will result in a right-hand circular polarization (RHCP) at horn 11. A linearly polarized wave applied to axial port 19*a* will result in a left-hand circular polarized (LHCP) wave at horn 11. The size and shape of the rectangular cross sections at the ends of compensation guides 15 and 16 are all the same. However, the central portion of compensation guide 15 has a decreased width with respect to the ends and the central portion of compensation guide 16 has an increased width with respect to the ends. As a result, the velocity of propagation through compensation guide 15 is faster than propagation through compensation guide 16**. The difference in the propagation velocities through the compensation guides depends upon the frequency of the propagation signal so that a different amount of phase shift takes place in each of the compensation guides at different frequencies. However, over a broad range of frequencies, the phase shift is about the 90° required to generate an ideal circularly polarized signal.

To obtain a spatial separation of 90° (in contrast to a time-based 90° phase separation) between two signal components derived from the same signal, Orthomode junction 19 is rotated 45° with respect to Orthomode junction 18. That is, the longitudinal axis of axial port **19*a* is rotated 45° with respect to the longitudinal axis of axial port 18*a*. Similarly, the circumferential position of radial port 19*b* is 45° displaced from the position of radial port 18*b*. As a result, a linearly polarized signal introduced into either port 19*a* or 19*b*, is split into two components having equal power and 90° displaced in space from one another, one component exiting through axial port 18*a* and one component exiting through radial port 18*b*. As these two components pass through compensation guides 15 and 16, there is a relative delay and they are displaced in phase 90° with respect to one another and then combined into a circularly polarized wave at Orthomode junction 12**.

Although the embodiment described converts a linearly polarized microwave signal to a circularly polarized signal, the conversion can be made to any two orthogonally polarized microwave signals, which are broadly termed elliptically polarized signals and include the special cases of linear polarization and circular polarization. The phase difference between the two orthogonally polarized microwave signals determines what type of signal is produced. As mentioned above, if the phase difference is 90° a circularly polarized signal is produced, if the phase difference is 180° another linearly polarized signal is produced, and if the phase difference is other than 0°, 90°, 180°, or multiples thereof, an elliptically polarized signal is produced.

If desired, linearly polarized signals can be introduced simultaneously at ports **19*a* and 19*b*** and used to produce both ideal right-hand and left-hand circularly polarized signals. The two linearly polarized signals will not interfere with one another if they are purely orthogonal and equal in magnitude. This is because a circularly polarized (CP) wave can be characterized as including orthogonal electric components. If the circularly polarized signal is ideal, that is $E_x$ and $E_y$ components are of equal magnitude and if these components are exactly 90° out of phase, then a circularly polarized signal of opposite hand may be introduced into a waveguide and this second circularly polarized signal will not interfere with the first.

Figure 3:
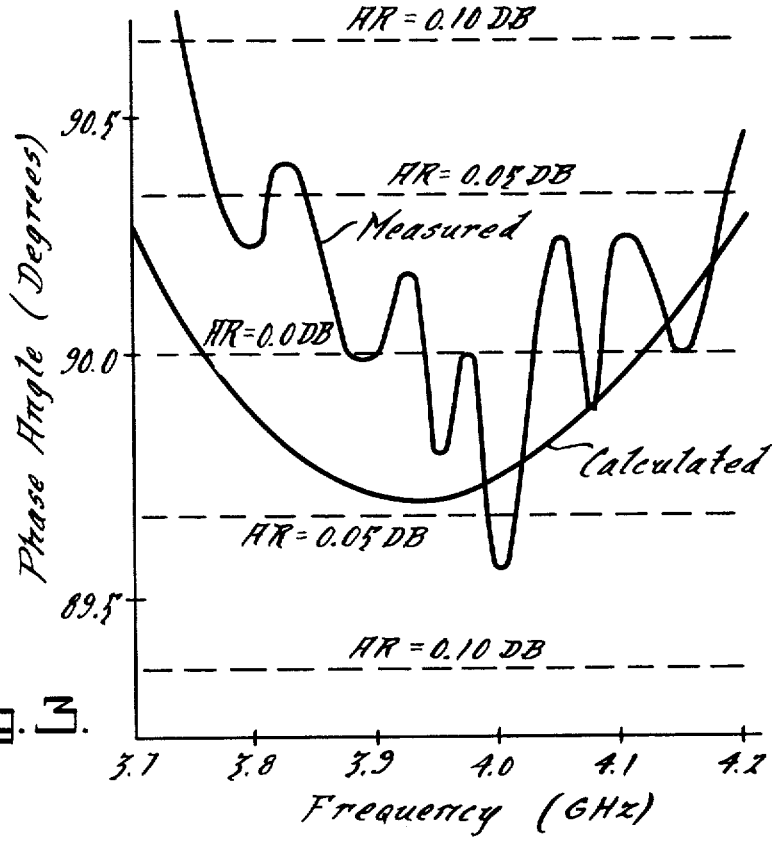
FIG. 3 is a graphical representation of the axial ratio vs. frequency of an embodiment of this invention using both measured and calculated data.

The present invention improves over prior art polarizers in that it provides, over a relatively wide frequency band, a polarizer for converting linearly polarized signals to circularly polarized signals and vice versa without the accompanying high axial ratios that have characterized prior art polarizers. This is of importance because high axial ratios in the circularly polarized signals cause interference between concurrently propagaged LHCP and RHCP signals. This interference can preclude the use of such simultaneous transmission in communication systems, an undesirable situation since simultaneous propagation of LHCP and RHCP signals effectively doubles the capacity of the microwave transmission system. With particular reference to FIG. 3, there is shown a graph illustrating axial ratio response vs. frequency for a circular polarizer constructed in accordance with this invention. The graph is based on measurements of the orthogonal electric field components $E_x$ and $E_y$ over the indicated frequency range for both RHCP and LHCP signals in the circularly polarizer. The axial ratios are in dB and are indicated by horizontal lines on the graph.

In one particular example, compensation waveguides are designed to produce a nearly 90° phase difference across the entire 3.7 to 4.2 GHz band. Simply making one waveguide a quarter wavelength longer than the other results in a narrow band polarizer as does simply making one guide narrower than the other. However, a combination of these two approaches yields two waveguides which will have a phase difference of exactly 90° at two different frequencies and which can be made nearly 90° everywhere between the two crossover frequencies. To show how this occurs, consider two waveguides having different widths and lengths. At the first frequency ($f_1$), designated by a subscript "1"; let the subscript "a" denote one waveguide and the subscript "b" denote the other waveguide, then:

$$\beta_{a,1} l_a + 90° = \beta_{b,1} l_b$$

where:

$l$ = length of each waveguide $\beta$ = propagation constant in waveguide $$\beta = \frac{360°}{\lambda}\sqrt{1 - \frac{\lambda^2}{2A}}$$

$\lambda$ = wavelength = $C/f_1$

C = velocity of light

A = width of waveguide and at the second frequency ($f_2$), designated by a subscript "2";

$$\beta_{a,2} l_a + 90° = \beta_{b,2} l_b$$

Rewriting the equations results in $$\frac{360°}{\lambda_1}\sqrt{1 - \left(\frac{\lambda_1}{2A_a}\right)^2}\, l_a + 90° = \frac{360°}{\lambda_1}\sqrt{1 - \left(\frac{\lambda_1}{2A_b}\right)^2}\, l_b$$

$$\frac{360°}{\lambda_2}\sqrt{1 - \left(\frac{\lambda_2}{2A_a}\right)^2}\, l_a + 90° = \frac{360°}{\lambda_2}\sqrt{1 - \left(\frac{\lambda_2}{2A_b}\right)^2}\, l_b$$

By specifying the two $\lambda$'s where phase matching is desired, there are two equations in four unknowns and two more variables can be constrained. It can be shown that this set of equations yields only one minima for the net phase function and therefore, only two crossover frequencies. It is advantageous to select $A_a$ and $A_b$ to minimize the deviation from 90° over a band of frequencies. It can be deduced from an examination of the equations that dispersion will be minimized when $A_a$ is as nearly equal to $A_b$ as possible, which also results in very large $l_a$ and $l_b$. This means that $A_a$ and $A_b$ should be selected as nearly equal as practical length considerations will allow. An appendix to this description illustrates the contribution of changing length and width to the composite polarizer characteristics. In order to design a polarizer for 3.7 to 4.2 GHz let:

$f_1$ = 3.762 GHz $f_2$ = 4.115 GHz $A_a$ = 2.2 inches $A_b$ = 2.38 inches then:

$$80.450224\, l_a + 90 = 86.293212\, l_b$$

$$95.179104\, l_a + 90 = 100.166570\, l_b$$

solving for $l_a$ and $l_b$ we get:

$l_a$ = 8.061

$l_b$ = 8.558.

It is now possible to write the net phase function at any frequency using the lengths and widths given above as:

$$\phi = \frac{3080.88}{\lambda}\sqrt{1 - \left(\frac{\lambda}{4.76}\right)^2} - \frac{2901.96}{\lambda}\sqrt{1 - \left(\frac{\lambda}{4.4}\right)^2}$$

where $\lambda$ is wavelength in inches. This equation is plotted in FIG. 3 and shows that a potential axial ratio of better than 0.05 dB can be achieved over the 3.7 to 4.2 GHz band.

Figure 4:
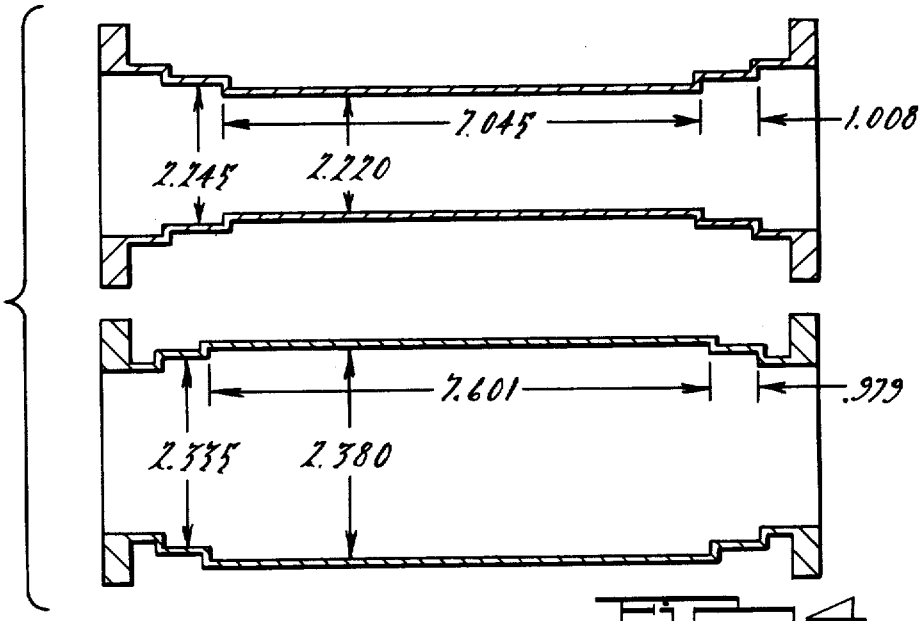
FIG. 4 is a longitudinal cross sectional view of two waveguides for a compensation means in accordance with an embodiment of this invention.

In this particular example, it was desired to use WR229 waveguide as the connecting waveguide for these phasing sections and low input VSWR was desired, a matching section was added at each end of each compensation waveguide. The waveguides were recalculated using the methods described above resulting in the dimensions shown in FIG. 4. The net phase function for these waveguides was calculated and is plotted in FIG. 3. FIG. 3 also has the actual measured phase of the compensation waveguides with the interconnect waveguide attached plotted for comparison with the calculated phase. Within the measurement error, the measured and calculated phase are nearly identical. These phasing guides when connected to the remainder of the feed will potentially yield an axial ratio of better than 0.05 dB over the 3.7 to 4.2 GHz band.

If in the above example, it had been desired to produce a polarization other than circular the 90° phase shift would be appropriately changed. That is, in the equation:

$$\beta_{a,1} l_a + 90° = \beta_{b,1} l_b$$

the 90° could be replaced by 180° to obtain another linear polarization or by an appropriate phase shift to produce elliptical polarization (i.e., a phase shift other than (0, 90°, 180° or multiples thereof). However, whatever desired phase shift is chosen, there will still be two different frequencies at which the phase difference is exactly equal to the desired phase shift and can be made nearly equal to the desired phase shift everywhere between the two crossover frequencies.

Figure 2:
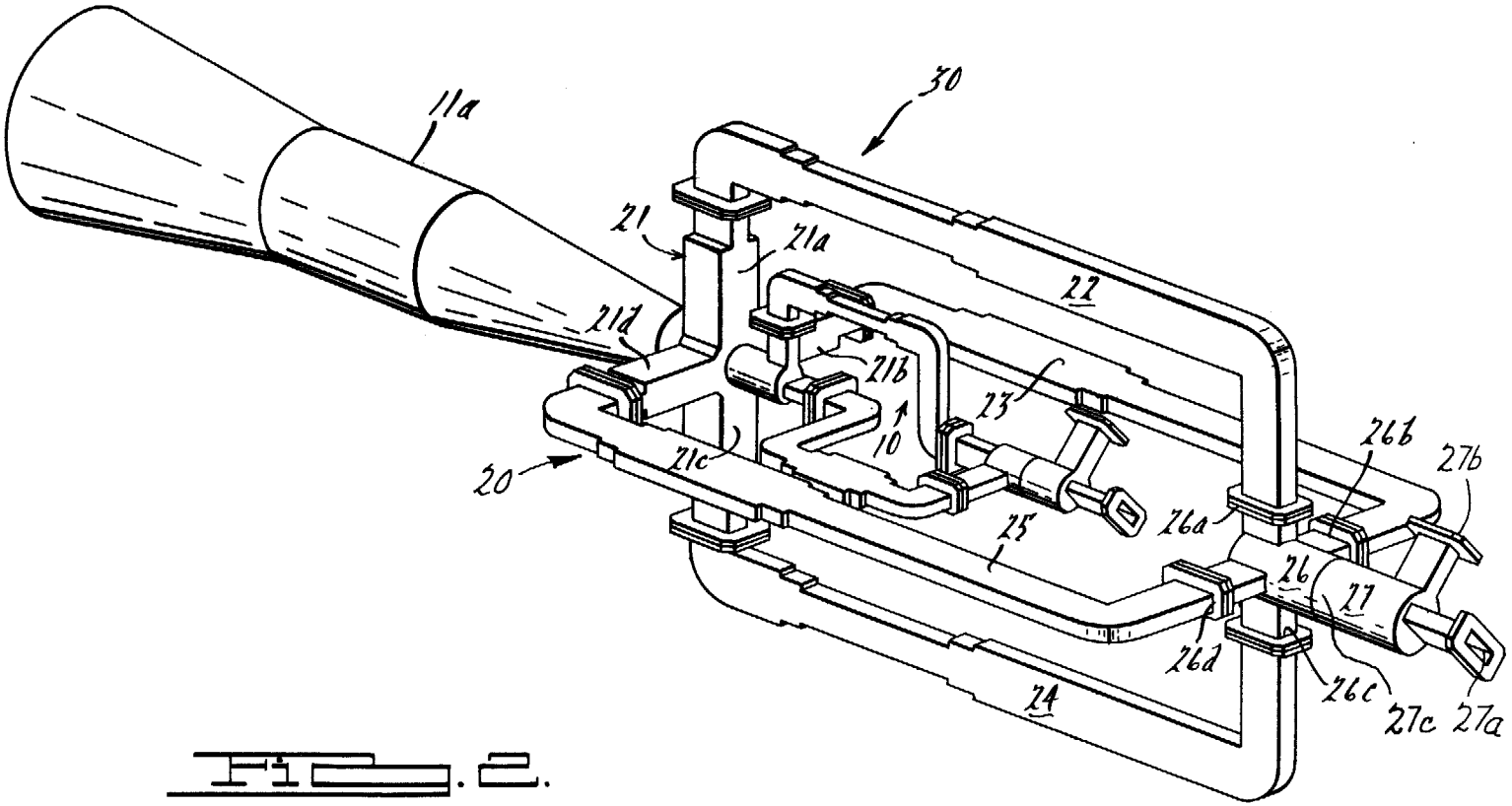
FIG. 2 is a perspective view of a circular polarizer in accordance with another embodiment of this invention particularly adapted for use with two frequencies and providing for circular polarization of each frequency.

Referring to FIG. 2, a diplexer apparatus 30 includes circular polarizer 10 shown in FIG. 1 in combination with a horn 11*a* and a circular polarizer 20. Generally speaking, circular polarizers 10 and 20 provide alternate paths to horn 11*a*. That is, if either two transmitters or two receivers use different frequencies, one frequency can be used in conjunction with circular polarizer 10 and the other frequency can be used in conjunction with circular polarizer 20. A turnstile Orthomode junction 21 provides a common communication junction between horn 11*a* and circular polarizers 10 and 20. Turnstile Orthomode junction 21 has a generally circular center portion and four rectangular openings 21*a*, 21*b*, 21*c* and 21*d* circumferentially spaced at 90° intervals around Orthomode junction 21. As is known, the power of a particular hand of polarization is split equally between opposing rectangular ports. Circular polarizer 20 differs from circular polarizer 10 in that four compensation guides are required. Compensation guides 22, 23, 24 and 25 extend between turnstile Orthomode junction 21 and a turnstile Orthomode junction 26. Turnstile Orthomode junction 26 has four rectangular circumferentially spaced ports 26*a*, 26*b*, 26*c* and 26*d* with the same circumferential positions as correspondingly lettered ports of turnstile Orthomode junction 21. Compensation guide 22 extends between ports 21*a* and 26*a*, compensation guide 23 extends between ports 21*b* and 26*b*, compensation guide 24 extends between ports 21*c* and 26*c*, and compensation guide 25 extends between ports 21*d* and 26*d*.

Opposing compensation guides 22 and 24 have a similar narrowing of waveguide width in a central portion. Analagously, opposing compensation guides 23 and 25 have a similar widening of waveguide width in a central portion. A three port Orthomode junction 27, has a circular section 27*c* and an axial circular opening coupled to an axial circular opening of turnstile Orthomode junction 26. Orthomode junction 27 has a rectangular axial port 27*a* and a rectangular radial port 27*b*. The circumferential position of radial port 27*b* is 45° displaced from adjacent rectangular ports 26*a* and 26*b* of turnstile junction 26. This is analagous to the relationship between Orthomode junctions 18 and 19 and provides for a 90° spatial phase shift for signals passing through the combination of junctions 26 and 27. If a signal is applied to either ports 27*a* or 27*b* these signals are divided into two vectors of equal magnitude and 90° displaced from each other in space. Half of each vector is then carried by opposing compensation guides and shifted in phase with respect to the two halves of the other spatially displaced vectors which are carried by the other two opposing compensation guides. The signals carried by compensation guides 22, 23, 24 and 26 are combined in turnstile Orthomode junction 21 to produce a circular polarized signal.

To isolate circular polarizer 10 from circular polarizer 20, turnstile Orthomode junction 21 includes a filter, for example a low pass frequency filter, to block signals from circular polarizer 10. Analagously, Orthomode junction 12 includes a filter such as a high pass frequency filter to block signals from circular polarizer 20. A low pass filter produces a short circuit for the higher frequency transmitted signals so that they do not pass and produces an open circuit or matched impedance for the lower frequency received signals so that they are efficiently coupled. Turnstile Orthomode junctions are used with a pair of diametrically opposed openings rather than a single opening for coupling each signal from the antenna horn in order to maintain symmetry in the circular waveguide and thereby reduce exitation of higher order modes.

Diplexer apparatus 30 (FIG. 2) operates with two mutually orthogonally polarized transmitted signals at one frequency and two mutually orthogonally polarized received signals at a second frequency in conjunction with a single antenna. As is known, one diplexer apparatus acts reciprocally with another diplexer apparatus and the transmitted signals under these frequencies can be reversed without necessitating a change in the apparatus itself. For purposes of discussion, circular polarizer 10 is associated with a transmitted signal and circular polarizer 20 is associated with a receiver signal. Generated signals for the transmitted signals are applied to circular polarizer 10 through ports 12*a* and 12*b*.

A pair of polarized received signals having their electric fields orthogonally related are received at horn 11*a* and passed through Orthomode junction 21 at a circular port in communication between the central portion of turnstile Orthomode junction 21 and horn 11*a*. The received signals are independently coupled from turnstile Orthomode junction 21 through ports 21*a*, 21*b*, 21*c* and 21*d*. One vector component of one signal divides equally into compensation guides 22 and 24 and the orthogonal vector component of the other signal similarly divides equally into compensation guides 23 and 25. The orthogonal vector components of each of the two signals are to be combined in turnstile Orthomode junction 26 after the phase shift in compensation guides 22, 23, 24 and 25. From turnstile Orthomode junction 26 they pass to an Orthomode junction 27 whereby a 90° spatial orientation of the signal takes place.

In operation, when transmitting, transmitter output signals at the same frequency are introduced into axial port 12*a* and radial port 12*b*. These signals are conducted to the central portion of circular section 12*c*. Because of the symmetry of the circular waveguide portion of Orthomode junction 12 and the propagation properties of the rectangular waveguide sections adjacent ports 12*a* and 12*b*, the two transmitter openings are isolated from each other. Exciting radial port 12*b* causes an electric field in the circular waveguide which is polarized perpendicular to the longer side of axial port 12*a*. Similarly, exciting axial port 12*a* causes an electrical field in the circular waveguide which is polarized perpendicular to the longer side of the radial port 12*b*. Since the longest side of the two ports 12*a* and 12*b* are perpendicular, the transmitted signals remain isolated from one another while producing orthogonal fields in the circular section of Orthomode junction 12.

On reception, a pair of orthogonally related signals at the lower frequency are directed from antenna horn 11*a* to turnstile Orthomode junction 21. The lower frequency signals are isolated from the transmitter by virtue of the smaller diameter circular waveguide of Orthomode junction 12, which is below cutoff at the received frequency. Thus, when the signals are received in the circular waveguide of Orthomode junction 21, they leave only through the openings coupling them to compensation guides 22, 23, 24 and 25.

Various modifications and variations will no doubt occur to those skilled in the various art to which this invention pertains. For example, the particular means of coupling the microwave energy into the diplexer apparatus may be varied from that described herein. These and all other variations which basically rely on the teachings through which this disclosure has advanced the art are properly considered within the scope of this invention.

APPENDIX

Figure 5:
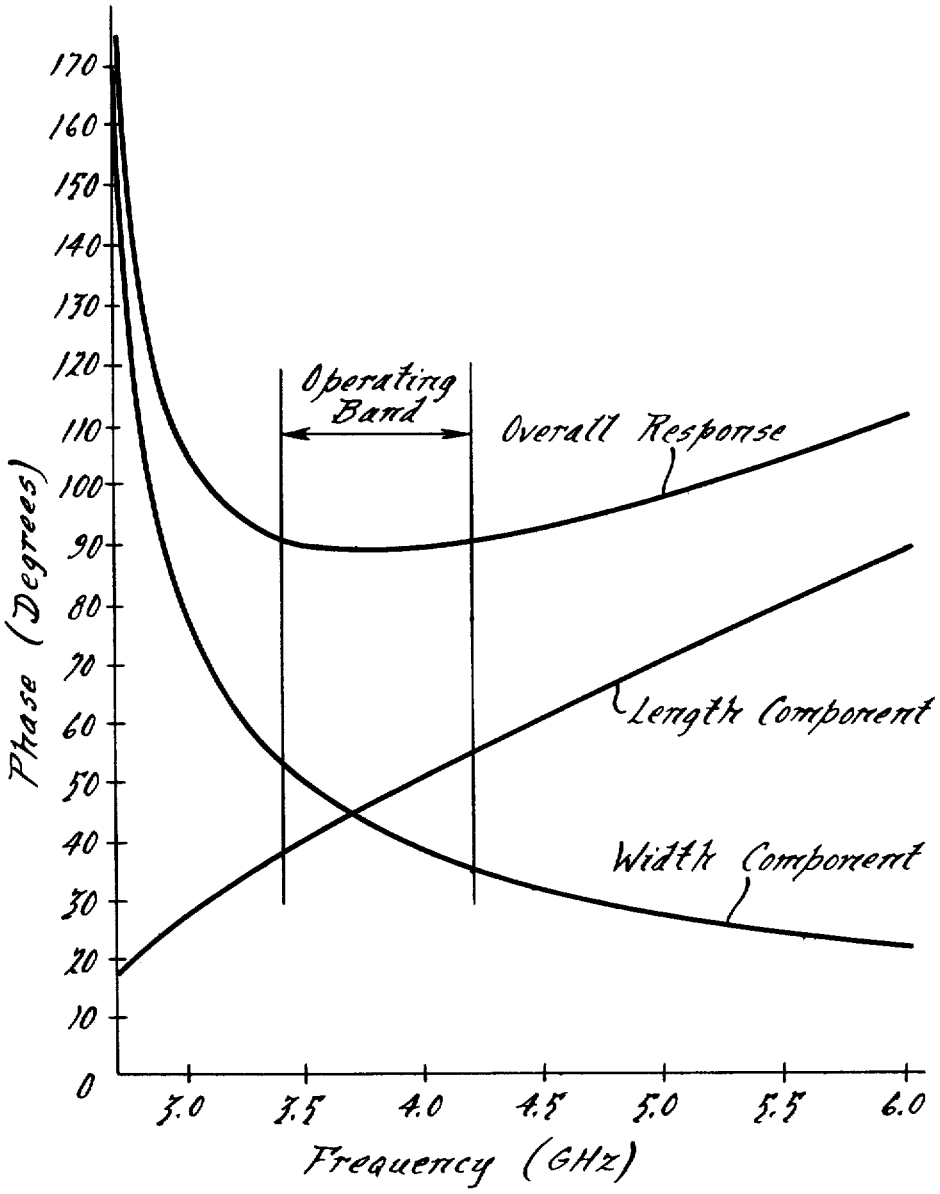
FIG. 5 is a graphical representation of the phase angle vs. frequency of a first polarizer having only a modified length, a second polarizer having only a modified width, and a third polarizer having a modified width and length in accordance with an embodiment of this invention.

FIG. 5 shows phase vs. frequency curves for three different polarizers. The first polarizer uses only a differential length to obtain 90' phase near the middle of its operating band resulting in a phase curve which increases monotonically with frequency. The second polarizer uses only a differential width to obtain the 90° shift which results in a phase curve that decreases monotonically with frequency. The third polarizer is in accordance with an embodiment of this invention and uses both differential length and differential width to obtain a saddle shaped phase curve. From the curves showing modification of only width or only length it can be seen that the departure from the desired phase of 90° is at least 17° at the edges of the operating band whereas the polarizer modifying both width and length deviates less than 1.1 degrees from the desired 90° over the operating band. For a polarizer using differential length only, the equations are:

Use basic width of WR229—2.290"

$$\phi = \frac{360}{\lambda}\sqrt{1-\left(\frac{\lambda}{2a}\right)^2}$$

adjust l for best phase 3.4 and 4.2 GHz $$\phi 3.4 = 67.646872011$$

$$\phi 4.2 = 101.15547521$$

let $$90 - 67.6487201l = 101.1554752l - 90$$
$$168.8023472l = 180$$
$$l = 1.066335883$$

$$\phi = \frac{383.8809179}{\lambda}\sqrt{1-\left(\frac{\lambda}{4.58}\right)^2}$$

For a polarizer using differential width only, in order to make the overall length about the same as the comparison polarizer select:

$a_1 = 2.11''$ and $a_2 = 2.47''$ $\frac{a_1 + a_2}{2} = 2.29''$ or the basic width of $WR229$.

$$\phi = \frac{360}{\lambda}\left(\sqrt{1-\left(\frac{\lambda}{2a_2}\right)^2} - \sqrt{1-\left(\frac{\lambda}{2a_2}\right)^2}\right)$$

adjust l for best phase between 3.4 and 4.2 GHz $$\phi 3.4 = 14.815823461$$

$$\phi 4.2 = 9.788564151$$

let $$90 - 141582346l = 9.78856415l - 90$$
$$24.60438761l = 180$$
$$l = 7.315768344''$$

$$\phi = \frac{2633.68}{\lambda}\left(\sqrt{1-\left(\frac{\lambda}{4.94}\right)^2} - \sqrt{1-\left(\frac{\lambda}{4.22}\right)^2}\right)$$

For a polarizer using differential width and length the equations are:

$$\phi = \sqrt{1-\left(\frac{\lambda}{4.76}\right)^2}\left(\frac{2844.36}{\lambda}\right) - \sqrt{1-\left(\frac{\lambda}{4.4}\right)^2}\left(\frac{2652.84}{\lambda}\right)$$

which may be separated into the width change and length change components as follows:

$$\phi = \left[\sqrt{1-\left(\frac{\lambda}{4.76}\right)^2}\left(\frac{191.52}{\lambda}\right)\right] + \left[\left(\sqrt{1-\left(\frac{\lambda}{4.76}\right)^2} - \sqrt{1-\left(\frac{\lambda}{4.4}\right)^2}\right)\left(\frac{2652.84}{\lambda}\right)\right]$$

whereon the first bracketed term is the length component and the second bracketed term is the width component.

What is claimed is:

1. A polarizer for converting a linearly polarized microwave signal to an elliptically polarized microwave signal and vice versa, said polarizer comprising:

compensation means for passing a signal between two points by a first path and a second path, said first and second paths producing a relative phase shift between the signal carried in said first path and the signal carried in said second path, said first and second paths each having a different length and width with respect to microwave signal propagation so that the phase vs. frequency characteristic of the signal has a point of inflection and there are two frequencies at which said phase shift is exactly a desired predetermined value, said first and second paths being rectangular waveguides and the signal passed by said first and second paths having a band of frequencies including two frequencies having said desired phase shift, the axial ratio being held to a specific design value over the band of frequencies, a first dual mode transducer for joining a first end of each of said first and second paths, a second dual mode transducer for joining a second end of each of said first and second paths;

said first and second dual mode transducers being adapted for joining two linearly polarized signals into one polarized signal and for splitting the power from one signal into two equal portions;

said first path including a longitudinally symmetrical decreasing and then increasing width with respect to longitudinal travel along said first path and;

said second path including a longitudinally symmetrical increasing and then decreasing width with respect to longitudinal travel along said second path, said increases being equal to said decreases in any given path, and only a decrease or an increase occurring in any given half about the midpoint of any given path.

2. A polarizer as recited in claim 1 wherein said increases and decreases occur in discrete steps.

3. A polarizer as recited in claim 1 wherein the width and length of said compensation means is determined in accordance with the following equation:

$$\frac{360^\circ}{\lambda_1}\sqrt{1-\left(\frac{\lambda_1}{2A_a}\right)^2}\,l_a + P^\circ = \frac{360^\circ}{\lambda_1}\sqrt{1-\left(\frac{\lambda_1}{2A_b}\right)^2}\,l_b$$

$$\frac{360^\circ}{\lambda_2}\sqrt{1-\left(\frac{\lambda_2}{2A_a}\right)^2}\,l_a + P^\circ = \frac{360^\circ}{\lambda_2}\sqrt{1-\left(\frac{\lambda_2}{2A_b}\right)^2}\,l_b$$

wherein the "a" subscript denotes one of said compensation means and the "b" subscript denotes the other of said compensation means, l indicates the length of a compensation means, "A" indicates the width of a compensation means $\lambda_1$ and $\lambda_2$ are the two wavelengths where there is an axial ratio of 0 dB, and P indicates the number of degrees of said desired phase shift.

4. A polarizer as recited in claim 3 wherein P is equal to 90° thereby adapting said polarizer to convert between linearly and circularly polarized signals.

5. A circular polarization means for changing polarization of a microwave signal between circular and linear including:

a first dual mode transducer for coupling power between a circular waveguide and two rectangular waveguides so that the power in each of the rectangular waveguides is one-half the power in the circular waveguide;

a second dual mode transducer for coupling power between two rectangular waveguides and a circular waveguide so that the power in the circular waveguide is twice the power in each of the rectangular waveguides;

compensation means for causing a phase shift between two signals, said compensation means including a first rectangular waveguide path and a second rectangular waveguide path extending from said first dual mode transducer to said second dual mode transducer, said first and second paths having a different length between said first and second dual mode transducer, said first path having a wide dimension which decreases then increases in magnitude, the decrease and the increase being symmetrically equal in magnitude so that there is a first central portion of decreased width relative to the remainder of said first path, said second path having a wide dimension which increases then decreases in magnitude, the increase and decrease being symmetric and equal in magnitude so that there is a second central portion of increased width relative to the remainder of said second path, said compensation means having dimensions so that there is a phase difference of 90° at two different frequencies of signals being conducted by said compensation means; and a third dual mode transducer having a circular waveguide portion coupled to the circular waveguide portion of said second dual mode transducer and two rectangular waveguide ports rotated 45° with respect to the rectangular waveguide ports of said dual mode transducer, said rectangular waveguide ports of said third dual mode transducer being adapted for passing signals uniquely associated with polarizations of the opposing sense.

6. A circular polarizer for converting a linearly polarized microwave signal to a circularly polarized signal and vice versa, said circular polarizer comprising:

a first transducer means having a first, second and third ports, said first transducer means being adapted to permit passage through said first port of first and second signals in a first frequency band which are orthogonally polarized with respect to each other, said first transducer means being adapted to permit passage through said second port of said first signal and to block passage through said second port of said second signal, said first transducer means being adapted to permit passage through said third port of said second signal and to block passage through said third port of said first signal;

a first polarization adjusting means having fourth, fifth, sixth and seventh ports, said fourth and fifth ports being coupled to said second and third ports, respectively, and being adapted to pass said first and second signals respectively, said sixth and seventh ports being adapted to pass two signals of said first frequency band which are orthogonally polarized with respect to each other, one of the signals passing through each of the ports, said first polarization adjusting means being operable to adjust the polarization of signals passing therethrough with a relatively high degree of isolation between polarizations over a relatively broad frequency band, said polarization adjusting means having a first compensation guide coupled between said fourth and sixth ports and a second compensation guide coupled between said fifth and seventh ports, said first and second compensation guides having a width and length suitable for adjusting the polarization of signals passing therethrough, by changing the relative phase with respect to time between the two signals;

a second transducer means having eighth, ninth, tenth and eleventh ports, said eighth and ninth ports being coupled to said sixth and seventh ports, respectively, said eighth and ninth signals being adapted to pass two signals which are orthogonally polarized with respect to each other, said second transducer means being adapted to adjust the relative spatial phase of the signals passing therethrough;

an electromagnetic wave conducting means having twelfth, thirteenth, fourteenth and fifthteenth ports, said electromagnetic wave conducting means being adapted to permit passage through said twelfth port of said first and second signals of said first frequency band and third and fourth signals in a second frequency band which are orthogonally polarized with respect to each other, being adapted to permit passage through said thirteenth port of said first and second signals and to block passage through said thirteenth port of said third and fourth signals, said conducting means being adapted to permit passage through said fourteenth port of said third signal and to block passage through said fourteenth port of said first, second and fourth signals, and being adapted to permit passage through said fifteenth port of said fourth signal and to block passage through said fifteenth port of said first, second and third signals, said thirteenth port being in communication with said first port;

a third transducer means having sixteenth, seventeenth, eighteenth and nineteenth ports, said sixteenth and seventeenth ports being adapted to pass signals of said second frequency band, said eighteenth and nineteenth ports being adapted to pass two signals of said second frequency band which are orthogonally polarized with respect to each other, one of the signals passing through each of the ports; and a second polarization adjusting means having a third compensation guide coupled between said fourteenth andd seventeenth ports and a fourth compensation guide coupled between said fifteenth and seventeenth ports, said third and fourth compensation guides having a width and length suitable for adjusting the polarization of signals passing therethrough with a relatively high degree of isolation between polarizations over a relatively broad frequency by changing the relative phase with respect to time between the two signals so that said third and fourth signals are received to produce two signals of said second frequency band which are orthogonally polarized with respect to each other.

7. A circular polarizer as recited in claim 6 wherein said third transducer means includes:

a third section of circular waveguide;

a fourth section of circular waveguide axially aligned with said third section of circular waveguide so that a first end of said third section is in communication with a first end of said fourth section;

said third section of circular waveguide having a second end, opposing said first end, with a first rectangular opening corresponding to said nineteenth port, and a second rectangular opening in the wall of said first section corresponding to said eighteenth port;

said fourth section of circular waveguide having a second end, opposing said first end, said second end being closed and a pair of circumferentially spaced rectangular openings in the wall of said fourth section corresponding to said sixteenth and seventeenth ports; and said seventeenth and sixteenth ports being rotated with respect to said eighteenth port about the central axis of said third and fourth sections so as to be circumferentially displaced from one another so that signals passing through said third transducer are polarized with respect to each other by being rotated in space relative to one another.

8. A circular polarizer as recited in claim 7 wherein said third section of waveguide includes a dual mode transducer and said fourth waveguide section includes a turnstile dual mode transducer and produces a 90° spatial phase shift between two components of a signal passing through said third transducer means.

9. A circular polarizer as recited in claim 8 wherein said second polarization adjusting means includes a fifth and a sixth compensation guide and said electromagnetic wave coupling means has two additional rectangular ports in the walls thereof respectively opposite the fourteenth and fifteenth ports, and said fourth circular waveguide has two additional rectangular ports opposite the sixteenth and seventeenth ports, the additional rectangular ports being connected in pairs by the said fifth and sixth compensation guides.

10. A circular polarizer as recited in claim 9 wherein said third compensation means has a central portion of decreased diameter with respect to the ends, said fourth compensation means has a central portion of increased diameter with respect to the ends, said compensation means which are diametrically opposed having central portions with similar widths so that opposing compensation means produce similar phase shifts on signals carried therein.

* * * * *